United States Patent [19]

Voltmer et al.

[11] Patent Number: 4,502,910

[45] Date of Patent: Mar. 5, 1985

[54] LITERATURE APPLYING MECHANISM

[75] Inventors: Helmut Voltmer, Park Ridge; Alfred F. Schwenzer, Totowa; Edward J. Mazur, Montville, all of N.J.

[73] Assignee: NJM, Inc., Fairfield, N.J.

[21] Appl. No.: 542,731

[22] Filed: Oct. 17, 1983

[51] Int. Cl.[3] ..... B65C 9/40

[52] U.S. Cl. ..... 156/361; 156/238; 156/344; 156/363; 156/249; 156/542; 156/552; 156/564; 156/566; 156/584

[58] Field of Search ..... 156/344, 584, 247–249, 156/235, 238, 240, 540–542, 566–568, 361–363, 552, 562, 564, 561, 573; 221/70–74

[56] References Cited

U.S. PATENT DOCUMENTS

| | | | |
|---|---|---|---|
| 3,415,705 | 12/1968 | Ettre | 156/540 |
| 3,708,371 | 1/1973 | Alie | 156/363 |
| 4,082,595 | 4/1978 | Slater | 156/361 X |
| 4,366,023 | 12/1982 | Voltmer | 156/363 X |

FOREIGN PATENT DOCUMENTS

| | | | |
|---|---|---|---|
| 1486988 | 6/1969 | Fed. Rep. of Germany | 156/552 |

*Primary Examiner*—David Simmons

*Attorney, Agent, or Firm*—Charles E. Baxley

[57] ABSTRACT

A system for the dispensing of literature to objects, such as containers carried by a conveyor, includes a tape for the application of adhesive to literature, and a device for the separation of the literature from the tape to permit the securing of the literature, adhesively, to the containers. A drive mechanism is provided for advancing the tape through successive increments of distance, each incremental distance being equal to the size of one piece of literature. A hopper dispenses the literature to the tape, one piece at a time. Application of the pieces of literature to the objects is accomplished by a roller or brush. The literature separation device includes a bar having an edge about which the tape is bent to free the literature from the tape as the tape advances around the edge. The adhesive is retained by the literature during the separation from the tape so as to permit the adhesive attachment of the pieces of literature to the containers.

9 Claims, 1 Drawing Figure

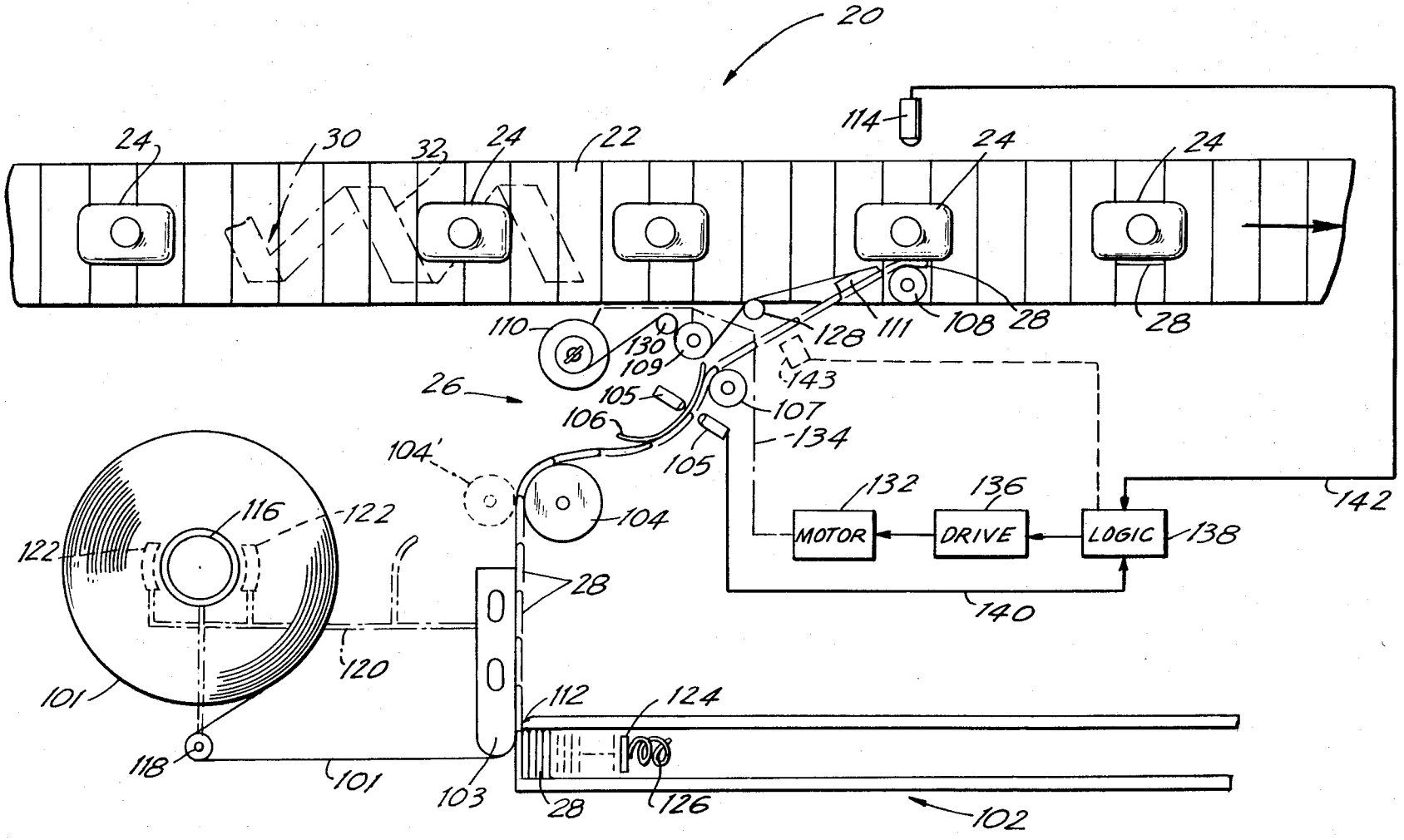
LOGIC
DRIVE
MOTOR
20
22
24
26
28
30
32
101
102
103
104
104'
105
106
107
108
109
110
111
112
114
116
118
120
122
124
126
128
130
132
134
136
138
140
142
143

LITERATURE APPLYING MECHANISM

BACKGROUND OF THE INVENTION

This invention relates to packaging equipment, and, more particularly, to a mechanism for applying labels to containers such as bottles and boxes.

Packaging equipment is commonly in use for the filling of containers, the closure of the containers, and the labeling of containers. Examples of containers in frequent use are the bottles and boxes found on the shelves in the marketplace utilized in the packaging of food and other items utilized both in the home and in industry. Such packages are provided with labels to identify the contents of the package, as well as to provide instructions in the use of the material contained within the package.

A problem arises in that there are occasions wherein there is insufficient room on a package label to provide all of the necessary data and instructions on the use of the material contained within the package. For example, in the distribution of medicinal products, literature in the nature of a multi-folded paper is attached desirably to the package, such multi-folded paper having adequate space to fully describe the material being packaged. However, the securing of literature, such as the foregoing multi-folded paper or a brochure of bound sheets of paper, is not applied readily by the type of mechanism utilized for applying a simple label. The bulkiness of the literature, and its tendency to open, necessitates the use of specially constructed equipment which can handle the folded or bound literature. Thus, the foregoing problem is manifested by an inadequacy of labeling equipment to affix folded and bound literature to a container, particularly a bottle used for the storage of medicine or food.

SUMMARY OF THE INVENTION

The foregoing problem is overcome and other advantages are provided by a literature-applying mechanism which is constructed in accordance with the invention to provide a tape having an adhesive thereon for the transporting of the literature from a hopper to the site of application of the literature to the container. The hopper includes a gate for metering out the literature, one piece at a time. Photoelectric sensors detect the presence of the literature and the presence of the container to insure that the arrival of the literature is synchronized with the arrival of the container at the site wherein the literature is secured to the container. At the site of application of the literature to the container, the tape is driven in a sharp bend around the edge of a peel plate which dislodges the literature from the tape; the adhesive has a greater affinity for the literature than the tape, and hence is separated from the carrying tape and stays with the literature so as to permit the literature to be urged against the side of the container by a pressure roll or brush.

BRIEF DESCRIPTION OF THE DRAWING

The foregoing aspects and other features of the invention are explained in the following description, taken in connection with the accompanying drawing wherein the sole FIGURE shows diagrammatically a mechanism incorporating the invention for applying literature to containers moving along a conveyor.

DETAILED DESCRIPTION

With reference to the drawing, there is shown a system 20 comprising a conveyor 22 which carries objects such as bottles 24 past a mechanism 26. In accordance with the invention, the mechanism 26 applies literature 28 to the sides of the bottles 24. By way of example in implementing the invention, a screw 30, shown in phantom, may be incorporated in the system 20 for guiding the bottles 24. The screw 30 has threads 32 which are spaced apart by a distance equal to a diagonal of a bottle 24 so as to more accurately position the bottles 24 as they sequentially pass by the mechanism 26 along the conveyor 22. The system is an "on-demand" system; thus a delivery system other than the feedscrew may be incorporated with the invention. It is understood that the bottles 24 are shown by way of example, and that other products of round and rectangular shape may be carried by the conveyor 22 for receiving literature 28.

The mechanism 26 employs a roll of adhesive transfer tape 101, and a hopper 102 which holds the literature. A pickup bar 103 guides the tape 101 past an opening of the hopper 102 to permit the adhesive layer on the tape 101 to engage with a piece of literature 28 in the hopper 102. The tape 101 then passes by a pair of rolls 104, 104' which force the literature 28 against the tape 101 to further secure the successive pieces of literature 28 to the tape 101.

The mechanism 26 further comprises an electric eye or sensor 105 for registering the presence of the literature, a reverse-arc plate 106, an idler roll 107, an applying roll 108, a draw roll 109, a drum 110 for receiving the backing paper of the tape 101, a peel plate 111 for releasing the pieces of literature 28 from the tape 101, an adjustable gate 112 on the opening of the hopper 102, and a sensor 114 for sensing a product such as bottle 24 on the conveyor 22. Also included in the mechanism 26 are a drum 116 upon which the tape 101 is initially wound, an idler 118 for guiding the tape from the drum 116 to the pick-up bar 103, and a frame 120 which is partially shown in phantom view, and mechanically connects and positions the drum 116, the idler 118, the pick-up bar 103, as well as other idlers and rolls of the mechanism 26.

The frame 120 also holds brake pads 122 against the drum 116 to provide a braking force during paying out of the tape 101 from the drum 116. In the hopper 102, a plunger 124 is driven by a spring 126 or a constant force spring motor (not shown) to force the piece of literature 28 towards the pick-up bar 103. An idler 128 is provided for guiding the tape 101 about the draw roll 109, and a pressure roll 130 forces the tape 101 against the draw roll. A motor 132 is mechanically connected to the draw roll 109 and to the drum 110, as indicated by a dashed line 134, and imparts rotation to the draw roll 109 and the drum 110 for advancing the tape 101 and for receiving a roll of the spent tape on the drum 110. An electronic drive circuit 136, of well-known design, provides electric signals for activating the motor 132 in response to signals of a logic unit 138 coupled to the drive unit 136.

The logic unit 138 is activated by signals along lines 140 and 142, respectively, from the literature sensor 105 and the product sensor 114. A signal from the product sensor 114 indicates that a bottle 24 has advanced to a position for receiving a piece of literature 28. A subsequent signal from the literature sensor 105 indicates that the tape 101 has advanced a sufficient amount for the completion of the application of the piece of literature 28 to the bottle 24. The logic unit 138 is responsive to the signals from the product sensor 114 and the literature sensor 105 to initiate the operation of the mechanism 26 for advancement of the tape 101 when the bottle 24 arrives in position, and to stop the operation of the mechanism 26 to terminate the advancement of the tape 101 when the piece of literature 28 is fully secured to the bottle 24.

In operation, the adhesive transfer tape 101 is provided in varying widths, the width being selected in accordance with the width of the literature which is to be dispensed by the mechanism 26. The requisite width of the tape is also determined by the desired height of the location of the literature on the bottles 24.

A roll of the tape 101 is placed in the drum 116 from which it may be unwound upon demand for a piece of literature 28 to be applied to a bottle 24. As the tape 101 is unwound, a tacky adhesive is exposed on the surface of the tape. The unwound tape 101 passes along the idler 118 which guides it to the hopper 102 and the pick-up bar 103. The bar 103 insures a constant pressure of the tape 101 against the pressure of the spring 126 or constant force spring motor (not shown) and the plunger 124 which urge the pieces of literature 28 toward the tape 101 and the bar 103.

As the tape 101 moves forward, the tackiness of the adhesive will move the literature out of the hopper 102. The literature gate 112 is adjustable to insure that one piece of literature moves out of the hopper 102 with each advance of the tape 101. The pick-up bar 103 is also adjustable relative to the frame 120, as by adjustment screws (not shown), to be accurately positioned adjacent the opening of the hopper 102; this insures that a desired amount of adhesive contacts the pieces of literature 28 to successively draw them out of the hopper 102.

With each advance of the tape 101, a further piece of literature 28 is drawn out of the hopper 102 and is mounted to the tape 101. The mounting of the pieces of literature 28 to the tape 101 proceeds sequentially with each advancement of the tape 101. Thus, there develops a chain of pieces of literature 28 which is driven past the adhesive bonding rolls 104, 104' which further presses the pieces of literature 28 against the backing paper of the tape 101 to insure complete adhesive coverage on the pieces of the literature 28. It is noted, that the adhesive will remain on the pieces of literature 28 after they are extracted from the tape 101 at the peel plate 111, this adhesive remaining on the literature 28 to be utilized in securing the literature 28 to the bottles 24. The chain of literature then passes the plate 106 which is provided with a reverse arc so as to create a space between the successive pieces of literature 28, such spacing permitting beams of light from the photoelectric sensor 105 to register each advance of the tape 101 and the literature thereon.

An alternate register system, shown in phantom, employs a reflective scanner 143 activated by a printed register mark on the literature 28 to terminate the forward motion of the tape 101 carrying the literature 28. This alternative scanning register system eliminates the need for the plate 106 and the photoelectric sensor 105.

The chain of literature then advances past the idler roll 107 which guides the literature onward in the direction of the peel plate 111. The tape 101 is guided around the end of the plate 111 by the idler 128 to the draw roll 109. Rotation of the draw roll 109 by the motor 132 pulls the tape 101 around the end of the plate 111 to peel a piece of literature 28 away from the tape 101 for advancement directly ahead into the space between the roll 108 and the bottle 24 to which the literature 28 is to be applied. Overhead clamping action is provided, preferably, by an overhead clamping belt of known construction, particularly in the use of light containers. The adhesive on the literature remains with the literature as it separates from the backing paper of the tape 101 so as to stick to the side of the bottle 24. Thereby, as the bottle 24 advances along the conveyor 22 past the roll 108, the roll 108 rotates to apply the literature 28 to the bottle 24. The spent tape 101, freed of the literature 28, then continues to advance on the back side of the peel plate 111 by the idler 128 and onto the draw roll 109. Rotation of the drum 110 along with the rotation of the roll 109 further advances the spent tape 101 past the idler 130 to be wound up on the drum 110.

Synchronization of the motion of the bottles 24 with the motion of the pieces of literature 28 is accomplished with the aid of the product sensor 114, the literature sensor 105, the logic unit 138, the drive unit 136, and the motor 132. As a bottle 24 is carried along the conveyor 22 to the applying roll 108, the product sensor 114 applies a signal via the logic unit 138 to the drive unit 136 to initiate operation of the motor 132. Thereby, the tape 101 begins to advance and a piece of literature 28 begins to separate from the tape 101 at the peel plate 111 to be applied by the roll 108 to the side of the bottle 24. The application of the piece of literature 28 to the bottle 24 continues until the literature sensor 105 applies a signal via the logic unit 138 and the drive unit 136 to terminate operation of the motor 132. The literature sensor 105 is so positioned relative to the chain of literature 28 at the plate 106 to signal the requisite amount of advancement of the tape 101 and the chain of literature 28 to indicate that the chain has moved forward by a spacing of one piece of literature 28. Thus, the signal of the literature sensor 105 on the line 140 designates the completion of the application of a piece of literature 28 to the side of the bottle 24. With respect to the construction of the circuitry of the logic unit 138, such circuitry may comprise a set-reset flip-flop (not shown) which is set by the signal on line 142 and reset by the signal on line 140 so as to provide a logic-1 signal to activate the drive unit 136. Alternatively, the logic unit 138 might comprise a latching relay (not shown) wherein the signal on line 142 latches the relay while the signal on line 140 restores the relay to its initial state. The motor 132 may be a well known DC (direct current) motor or stepping motor with the circuitry of the drive unit 136 being of a corresponding well-known form for driving the motor 132.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

We claim:

1. A system for applying single and multi-folded sheets of literature to an object having a side wall for receiving the literature comprising:

a hopper having an exit gate positioned for dispensing a piece of the literature;

means for pressing a piece of the literature against the side wall of the object;

means for guiding the object past said pressing means;

a tape having an adhesive coating on a front side thereof for carrying pieces of the literature to said pressing means;

means for guiding said tape past an opening in said hopper through which the literature is dispensed, said guiding means including a pick-up bar disposed at said opening and being in contact with a back side of said tape, said bar guiding said tape past a terminal piece of literature in said hopper and past said gate, said hopper including means for urging literaure toward said bar resulting in a pressing of the terminal piece of literature against the adhesive coating on said tape, said terminal piece of literature adhering to said tape to move therewith;

means responsive to the position of said object at said pressing means for moving said tape to deliver a piece of the literature to said pressing means, a movement of said tape past said hopper opening withdrawing a piece of literature adhering to said tape, withdrawn literature being metered by said gate;

means responsive to the movement of said tape for transferring a piece of the literature from the tape to the pressing means, adhesive of the tape being retained upon the piece of literature, thereby to press the literature against the object and secure the piece of literature to the object.

2. A system according to claim 1 wherein said tape moving means comprises:

means for sensing the position of said object;

means for sensing the position of literature on said tape; and means responsive to signals of each of said sensing means for advancing said tape past said transferring means by an amount sufficient to deliver one piece of the literature to said pressing means.

3. A system according to claim 2 wherein said tape moving means further comprises:

means coupled to said advancing means for unwinding fresh tape;

means for winding up spent tape; and wherein said winding means is located downstream of said transferring means for receiving the spent tape from the transferring means, adhesive retained by a piece of the literature securing the piece of literature to the side wall of the object under pressure of said pressing means.

4. A mechanism for applying single and multi-folded sheets of literature to objects carried by a conveyor and having literature-receiving surfaces comprising:

means for supplying adhesively coated tape;

means for dispensing literature one piece at a time to the tape, adhesive on the tape securing the pieces of literature to the tape;

said dispensing means including an opening through which literature is applied to said tape, a pick-up bar located at said opening, said tape passing between said bar and said opening with an adhesive coating facing said opening, and means for urging literature toward said bar, thereby to bring a terminal piece of said literature in adhering contact with said tape, movement of said tape withdrawing a piece of literature from said dispensing means;

means for moving the tape from said dispensing means toward an object which is to receive a piece of the literature, pieces of literature being carried by the moving tape;

means for transferring a piece of the literature from the tape to the object; and means for receiving the tape after removal of literature therefrom by said transferring means.

5. A mechanism according to claim 4 wherein said transferring means comprises:

a bar with an edge;

means for directing the tape around said edge for separating a piece of literature from the tape; and means for pressing a piece of literature, separated from said tape, against the object.

6. A mechanism according to claim 5 wherein adhesive on the surface of the tape is retained by a piece of the literature upon separation of the literature from the tape by said transferring means, said directing means including idler rollers for positioning the tape relative to said bar, and wherein said pressing means includes a roller which rotates upon movement of the object for pressing a piece of literature against the object so as to make adhesive contact between the literature and the object.

7. A mechanism according to claim 5 wherein said moving means comprises means for sensing pieces of literature carried by the tape for advancement of the tape by the distance of one piece of the literature.

8. A mechanism according to claim 7 wherein the sensing means includes a reverse-arc plate about which the tape is bent to separate successive pieces of the literature by an amount sufficient to permit the passage of light between successive pieces of literature for operation of said sensing means.

9. A mechanism according to claim 8 wherein said dispensing means includes gate means at said opening and adjacent said bar for limiting the amount of literature dispensed to one piece at a time.

* * * * *